US007038689B2

(12) United States Patent
Willis

(10) Patent No.: US 7,038,689 B2
(45) Date of Patent: May 2, 2006

(54) SPARSE REFRESH DOUBLE-BUFFERING

(75) Inventor: Thomas E. Willis, Mountain View, CA (US)

(73) Assignee: Intel Corporation, Santa Clara, CA (US)

( * ) Notice: Subject to any disclaimer, the term of this patent is extended or adjusted under 35 U.S.C. 154(b) by 517 days.

(21) Appl. No.: 10/079,621

(22) Filed: Feb. 19, 2002

(65) Prior Publication Data

US 2003/0156083 A1 Aug. 21, 2003

(51) Int. Cl.
*G09G 5/39* (2006.01)

(52) U.S. Cl. ..... 345/531; 345/539; 345/545

(58) Field of Classification Search ..... 345/30, 345/84, 55, 530, 531, 539, 545, 536; 711/101, 711/106, 110; 348/714
See application file for complete search history.

(56) References Cited

U.S. PATENT DOCUMENTS

| | | | | |
|---|---|---|---|---|
| 5,543,824 | A * | 8/1996 | Priem et al. | 345/539 |
| 5,576,731 | A | 11/1996 | Whitby et al. | |
| 5,587,726 | A * | 12/1996 | Moffat | 345/539 |
| 5,742,788 | A * | 4/1998 | Priem et al. | 711/110 |
| 5,801,718 | A * | 9/1998 | Shimizu et al. | 345/534 |
| 5,850,232 | A | 12/1998 | Engstrom et al. | 345/511 |
| 5,861,879 | A * | 1/1999 | Shimizu et al. | 345/213 |
| 5,940,067 | A | 8/1999 | Greene | |
| 5,963,221 | A * | 10/1999 | Shimizu et al. | 345/539 |
| 6,118,500 | A * | 9/2000 | Kunzman | 348/771 |
| 6,326,980 | B1 * | 12/2001 | Worley, III | 345/691 |
| 6,724,363 | B1 | 4/2004 | Satoh et al. | |
| 6,750,838 | B1 * | 6/2004 | Hirakata | 345/98 |
| 6,756,987 | B1 * | 6/2004 | Goyins et al. | 345/540 |
| 2002/0085013 | A1 * | 7/2002 | Lippincott | 345/572 |
| 2002/0190994 | A1 | 12/2002 | Brown | |

FOREIGN PATENT DOCUMENTS

| | | |
|---|---|---|
| AU | 200042674 | 1/2001 |
| EP | 0 608 053 | 7/1994 |
| EP | 0 608 056 | 7/1994 |
| GB | 2 223 651 | 4/1990 |

OTHER PUBLICATIONS

K. Auel, *One Frame Ahead: Frame Buffer Management For Animation And Real-Time Graphics*, Computer Graphics Proceedings of the Conference, vol. 88, 1988, pp. 43-50.

* cited by examiner

*Primary Examiner*—Henry N. Tran
(74) *Attorney, Agent, or Firm*—Trop, Pruner & Hu, P.C.

(57) ABSTRACT

A spatial light modulator having a double-buffering pixel value storage mechanism. A double-buffering mechanism enabling sparse refresh. A double-buffering value storage mechanism suitable for use with a serial or raster value producer and a value consumer, especially those in which it is desirable to consume an entire, completed frame or set of values at a time, and particularly those in which it is desirable to enable the producer to continue producing serially while the consumer is consuming in parallel fashion.

29 Claims, 4 Drawing Sheets

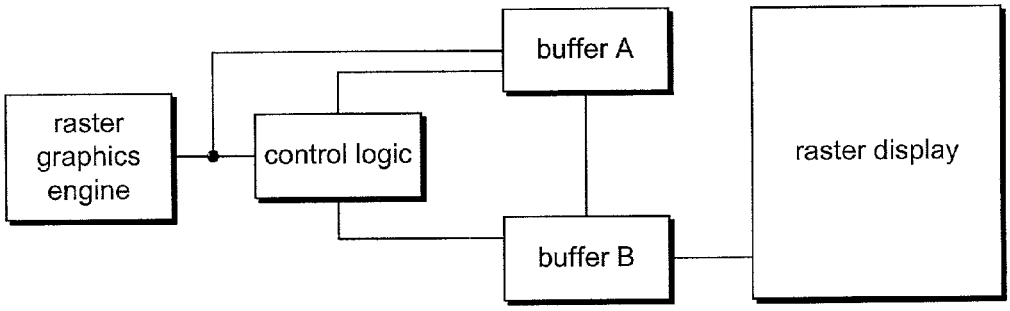
Fig. 1 - prior art 10
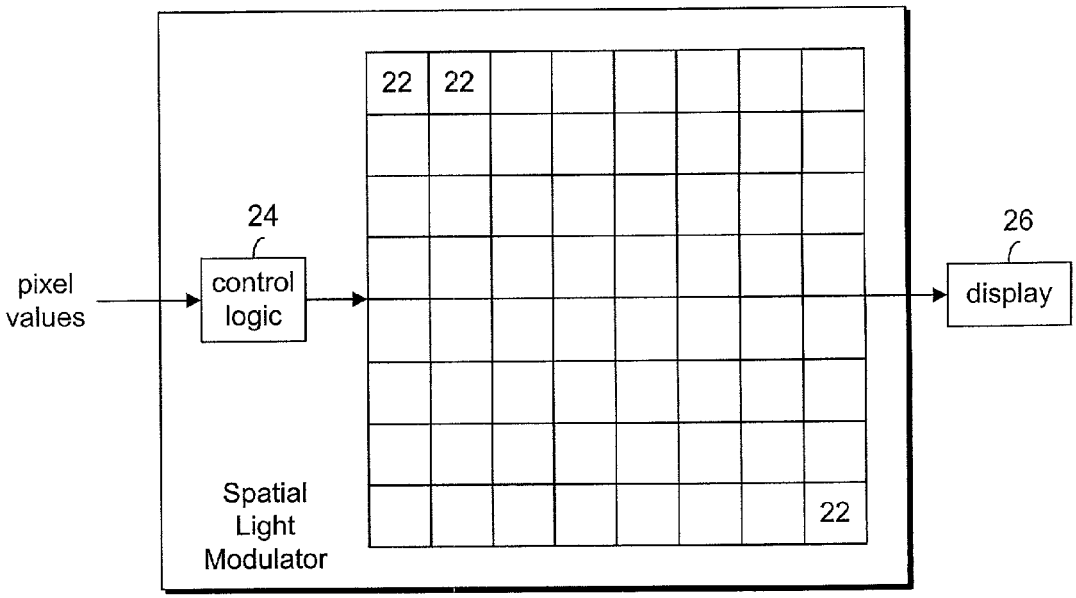
Fig. 2 - prior art 20

SPARSE REFRESH DOUBLE-BUFFERING

BACKGROUND

Double-buffering systems are used to provide atomic or at-once update of a set of output data. They are employed in applications in which it is undesirable to present a partially-updated set of output data. One such application is displays such as for personal computers, in which presentation of a partially-updated frame causes the visually undesirable result of "tearing" in which, for a brief time, part of a prior frame is displayed simultaneously with part of a next frame.

FIG. 1 shows an ordinary graphics system 10 which uses double-buffering to avoid such undesirable effects. A raster graphics engine provides pixel data to a first buffer ("buffer A") or "back buffer". Upon completion of a frame, control logic transfers the completed frame to a second buffer ("buffer B") or "front buffer", which drives a raster display device, such as a cathode ray tube (CRT) display. While that is happening, the graphics engine starts building the next frame in the first buffer. In alternative systems, the two buffers operate in "ping-pong" fashion rather than "back-front" fashion.

FIG. 2 shows a spatial light modulator (SLM) 20, which is a special case of display. SLMs are used to inject graphical or video content into a light beam. They can be reflective or transmissive. An SLM can be simplistically envisioned as an X by Y grid or array of pixel elements or cells 22, each of which controls the amount of light reflected or transmitted through its geographic region of the SLM. The array is controlled by control logic 24, and its output may be directed to a display 26 or used otherwise.

Each pixel element typically consists of an analog device such as a liquid crystal cell which responds to a voltage or current applied to its electrode. Commonly, there may be plural subsets of pixel elements each dedicated to a distinct color space, such as red, green, and blue pixel elements in an RGB display. Each pixel element is typically driven according to a multi-bit pixel color value stored in a storage location uniquely associated with that pixel element.

In conventional display and SLM systems, the entire image is regenerated each new frame. This might be termed "complete refresh". In the future, displays may use "sparse refresh", in which only changed portions of the image are generated for a new frame.

Traditional back-front or ping-pong double-buffering does not work in sparse refresh systems, because in the known double-buffering systems, one of the buffers (the back buffer, or the ping-pong buffer not presently driving the display) are completely regenerated (meaning all of its locations will be rewritten) before being committed to the display. If used with a conventional double-buffering system, sparse refresh would leave neither buffer holding a complete and current image. What is needed, then, is a double-buffering system which allows sparse refresh without tearing and so forth.

BRIEF DESCRIPTION OF THE DRAWINGS

The invention will be understood more fully from the detailed description given below and from the accompanying drawings of embodiments of the invention which, however, should not be taken to limit the invention to the specific embodiments described, but are for explanation and understanding only.

FIG. 1 illustrates a double-buffered raster display system according to the prior art.

FIG. 2 illustrates a spatial light modulator according to the prior art.

DETAILED DESCRIPTION

While the invention will be described in terms of its application to display technology, and specifically to SLM display technology, the reader will appreciate that the invention can readily be utilized in other areas of technology, as well, and that the claims are not to be read as though limited to SLMs or displays. Similarly, while the invention is described with reference to updating frames of pixel values, the double-buffering invention can readily be used with other types and sizes of data in other applications. For example, it may be used in storage, memory, caching, or other situations. Thus, it can more generically be said that the invention enables sparse refresh double-buffering of multiple values from a source to a destination. The destination may be an SLM, a memory, or whatever.

One motivation for using the invention might be that, due to the nature of the application, it is undesirable to present incompletely updated frames or sets of data. Another might be the desire to employ sparse refresh or update of the data, to reduce the bandwidth required or the power consumed. The reader will, doubtless, find other motivations and usages after studying this disclosure.

Figure 3:
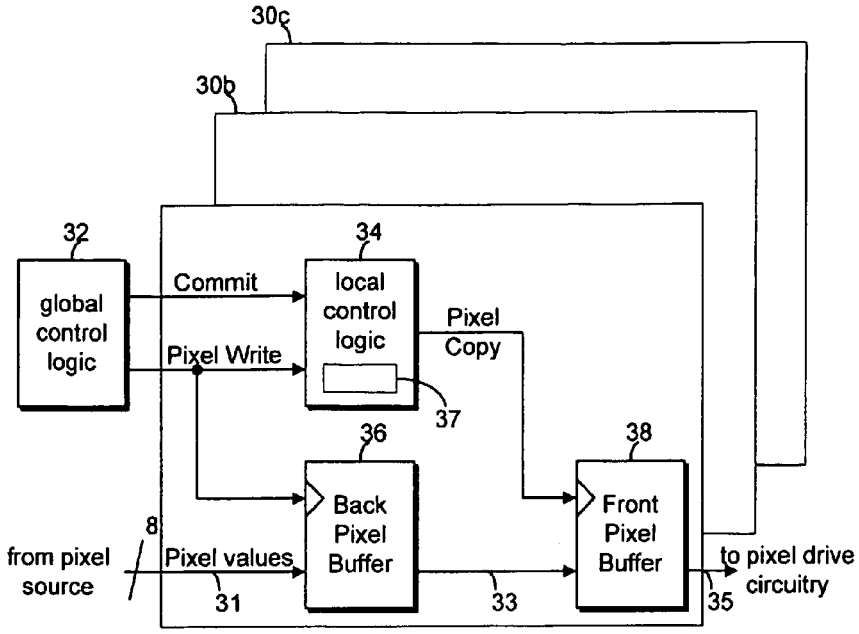
FIG. 3 illustrates one embodiment of the double-buffered circuitry of this invention.

FIG. 3 shows a back front embodiment of a representative one of a plurality of double buffering circuits 30*a*–30*c* (only one of which is fully shown in FIG. 3). Global control logic 32 controls the operation of all pixels. Each pixel has local logic including local control logic 34, a back pixel buffer 36 with a value input and a control input, and a front pixel buffer 38 with a value input and a control input. The back pixel buffer holds the new pixel value while the frame buffer is being updated. The front pixel buffer holds the present value that is being driven to the SLM pixel and displayed to the user.

The back pixel buffer has a value input at which it receives a pixel value, typically a multi-bit pixel value such as an 8-bit Green value, as one example, as shown in FIG. 3. The pixel value is received over a serial or parallel link 31 from the pixel source, such as a graphics engine. The global control logic determines when this particular pixel cell's pixel value is being written by the pixel source (which writes serially to the various pixels), and issues a pixel write signal to this pixel cell's double-buffering circuitry, causing the back pixel buffer to read or latch the pixel value. The local control logic receives the pixel write signal, as well as a commit signal from the global control logic. The commit signal indicates when the value in the back pixel buffer should be committed or written to the front pixel buffer; meaning typically that this frame's updates are now completed.

Upon receiving the pixel write signal, the local control logic sets a "dirty bit" 37 indicating that the pixel has been written to. If the dirty bit is set when the commit signal is received, the local control logic issues the pixel copy signal, causing the front pixel buffer to read or latch the new pixel value from the back pixel buffer, and clears the dirty bit.

The commit signal may be implicit, or it may be explicit, depending upon the needs of the particular application. That is, it may be implicitly generated by the global control logic after all the pixels in some set are written to the array, or it may be explicitly generated by the pixel source itself. For example, a system with selective refresh might present packets with rectangular regions of pixels that are to be updated to the SLM. The semantics of the regions may be such that the commit signal is asserted after the pixels in the region are written into the pixel array. Or, the pixel source may use a predetermined packet type to indicate that the commit signal should be issued.

Figure 4:
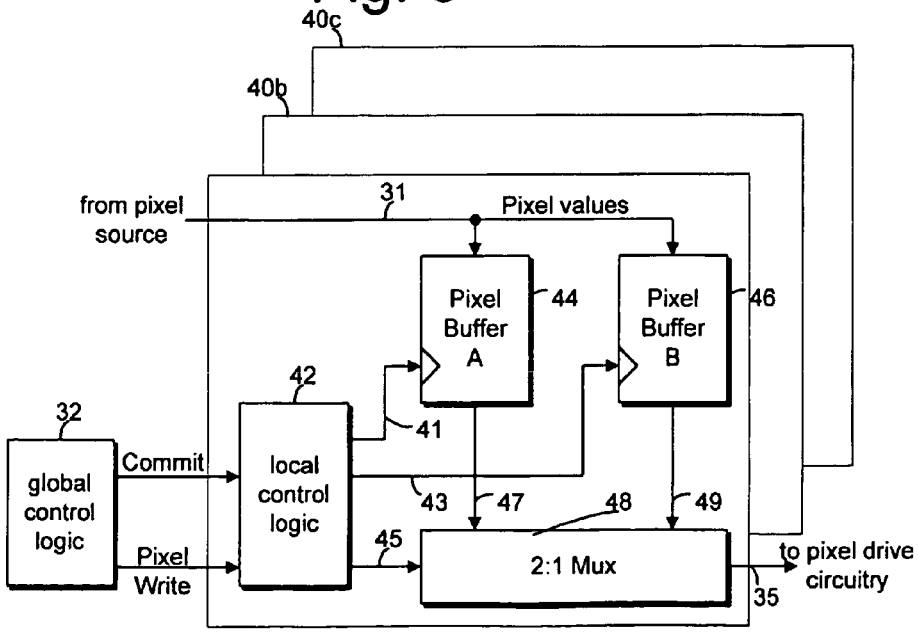
FIG. 4 illustrates another embodiment of the double-buffered circuitry.

FIG. 4 shows a ping pong embodiment of a representative one of a plurality of double buffering circuits 40*a*–40*c* (only one of which is fully shown in FIG. 4) which may be used in an SLM or the like. The pixel value is received by a first pixel buffer 44 ("pixel buffer A") and a second pixel buffer 46 ("pixel buffer B") in parallel. The local control logic 42 provides either a first read enable signal 41 to the first pixel buffer, or a second read enable signal 43 to the second pixel buffer, so only one of them will latch the new value. In some embodiments, the local control logic may issue a single read enable signal to both buffers, with one of them having an inverted input.

The local control logic provides a mux select signal 45 to a multiplexor 48 which, accordingly, passes through the output of either the first or the second pixel buffer to the pixel drive circuitry (not shown). While the new frame is being constructed, the mux will be controlled to pass the output of the pixel buffer which was not enabled to latch the new value, or, in other words, the old pixel value. In response to the commit signal from the global control logic, the local control logic will clear its dirty bit as described above, and will then toggle the mux control signal, causing the new value to be provided to the pixel drive circuitry. The pixel write signal operates as described above.

FIGS. 3 and 4 have been described with reference to one example scenario in which there is one double-buffering circuit dedicated to each pixel, and in which that double-buffering circuit has a dedicated local control logic, and dedicated back and front buffer storage elements, and there is a dedicated dirty bit for each pixel. However, the reader should appreciate that, depending upon the needs of the application, the system may be differently partitioned. The pixel write signal may more generically be regarded as a region write signal, and the system may contain more than one of them. The display may be divided into distinct regions, such as rectangles, each having its own region write signal, and each thus being atomically updated to the display independently of the other regions. The regions may be regular, or they may be irregular. They may have different sizes and/or shapes. They may be hard-wired and static, or they may be dynamically determined such as under program control. They may be non-overlapping, or they may be overlapping; for example, in an RGB display, the red pixels could be one region, the green a second, and the blue a third. The pixels in a region can share a single dirty bit.

Furthermore, it is not necessarily the case that each pixel have its own, dedicated local control logic. Each region may have its own, single local control logic, with appropriate fanout of its pixel copy signal to all of the pixels in that region.

And it may, in some applications, be desirable to implement the various pixels' or regions' pixel buffers in a variety of partitionings. As one example, each pixel may have its own, distinct buffers, and in some cases they may be built directly within the confines of that pixel's display area. As another, each X-pixel-wide row of the display may have its own X-wide buffer, and in some cases these may be built at the edge of the display area adjacent their respective rows. As another, all of the buffer storage may be built together in a unified block.

Figure 5:
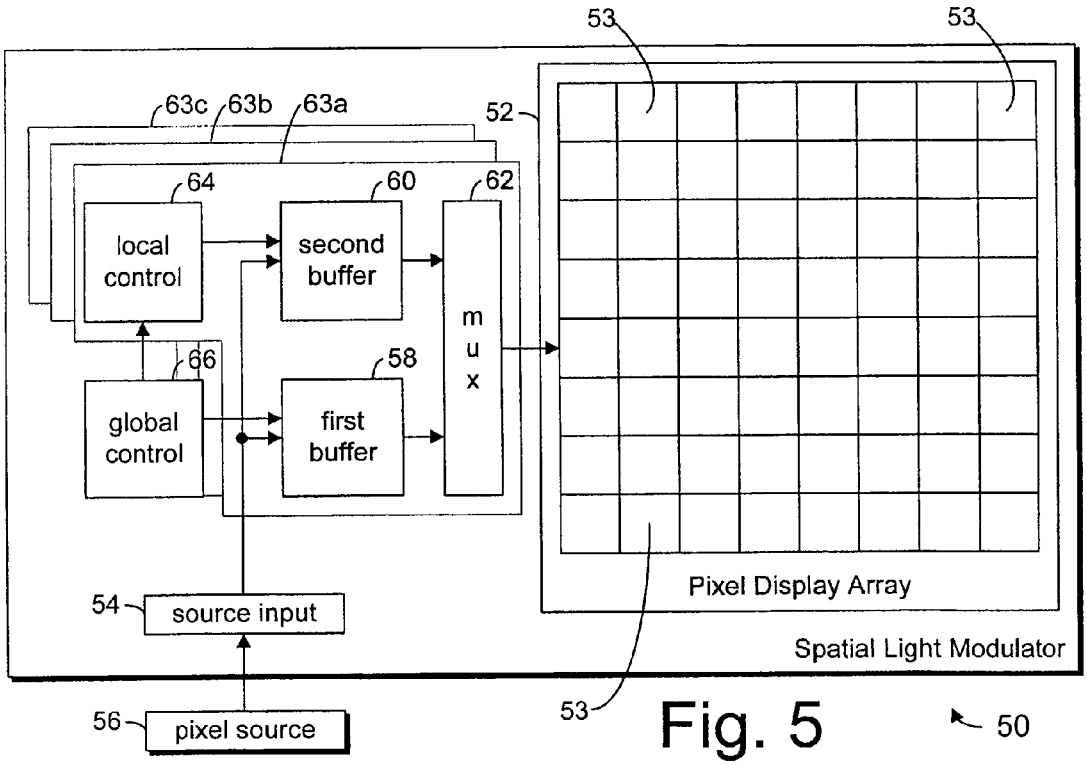
FIG. 5 illustrates one embodiment of a spatial light modulator including the double-buffered circuitry of this invention.

FIG. 5 shows one embodiment of an SLM 50 having pixel display cells or elements 53 (representative such cells are shown in FIG. 5) built to incorporate either embodiment of the double-buffering circuitry (which is shown somewhat generically and is intended to suggest either of the two embodiments, or other suitable mechanisms, and should be understood to also represent region-based embodiments not just pixel-based embodiments). Pixel values arrive at a source input 54 from a pixel source 56 which may be external to the SLM in many embodiments. From there, the pixel values are provided to the first and second pixel buffers 58, 60 of double-buffering circuits 63*a*–*c* of the various pixel array cells. For simplicity in illustration, only a single pixel array cell's double-buffering circuitry 63*a* is shown in full. The global control logic 66 controls the local control logic 64. The control logic controls the buffers and the multiplexor 62, as described above. The output value is provided to pixel drive circuitry (not shown) which may typically include a digital-to-analog converter, a pulse width modulation circuit, or other suitable means for driving the pixel's electrode. The pixel drive circuitry is typically, but not necessarily, located within the pixel cell's geographic region.

Figure 6:
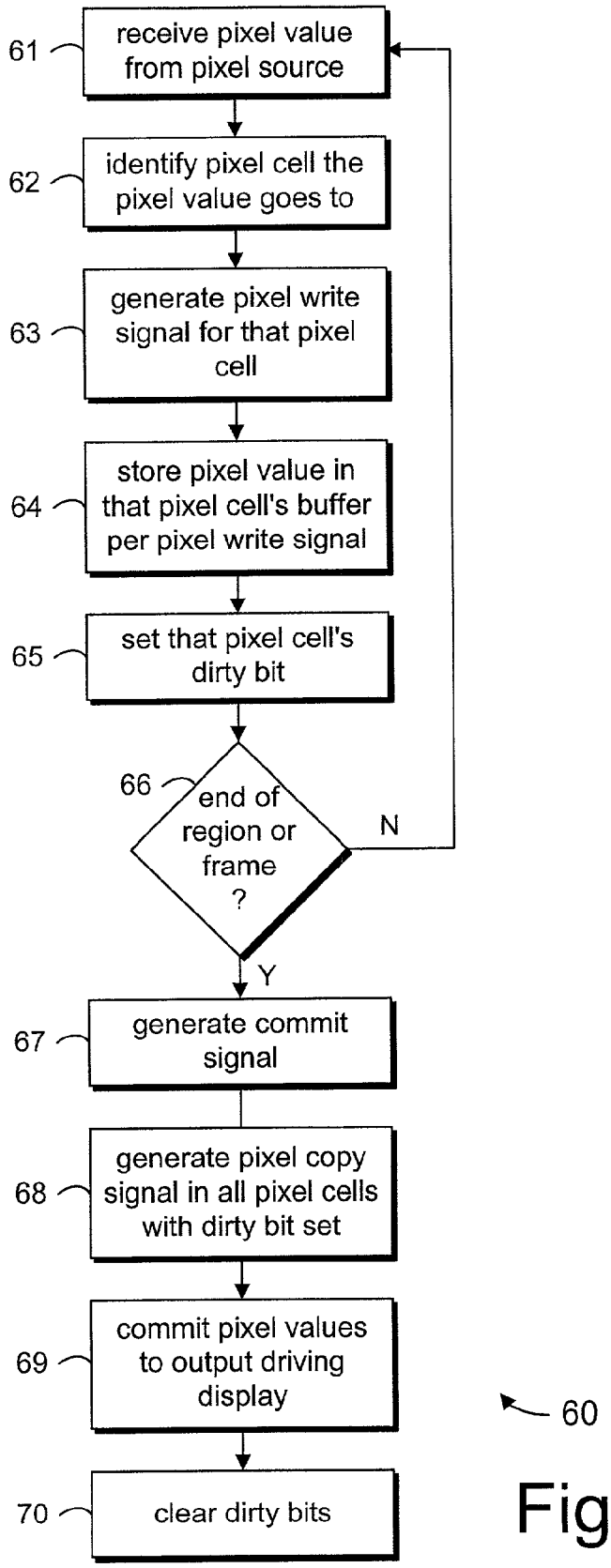
FIG. 6 illustrates one embodiment of a method of operation of the double-buffering system of this invention.

FIG. 6 shows one embodiment 60 of a method of operation of the double-buffering circuitry. A pixel value is received (61) from the pixel source. The pixel cell into which this pixel value is being written is identified (62), and a pixel write signal is generated (63) for that cell. In response to the pixel write signal, the pixel value is stored (64) in that pixel cell's buffer, and that pixel cell's dirty bit is set (65). If (66) the pixel source has not finished writing to this region, (or to this frame, for example) operation continues by receiving (61) a next pixel value for it, and so forth. Otherwise (66), a commit signal is generated (67). In response to the commit signal, a pixel copy signal is generated (68) in all pixel cells that have been written to (or, in other words, those that have their dirty bits set). In response to the pixel copy signal, each such pixel cell commits (69) its respective newly-stored pixel value to an output of the pixel cell which is, for example, driving a display pixel, and clears (70) its dirty bit. In a back-front double-buffering system, the committing (69) includes copying the pixel value from the back buffer to the front buffer. In a ping-pong double-buffering system, the committing (69) includes inverting the multiplexor control signal.

While the invention has been described in terms of an SLM, the reader will appreciate that the double-buffering invention taught by this disclosure may find usefulness in other applications, as well, especially those in which a serial or raster value producer is coupled to a parallel value consumer. The graphics engine is one example of a serial or raster value producer. The SLM is one example of a parallel value consumer.

And while the invention has been described with reference to buffering values which are pixel values, the reader will appreciate that the invention may be utilized in other applications involving other types of data, as well. In such applications, the pixel write signal may simply be termed a "write signal", which term may also generically apply to its embodiment as a pixel write signal. Similarly, the pixel copy signal may be simply termed a "copy signal".

There are many suitable ways of describing the various values. The value from the pixel source may be termed a "new value" or a "next value" or the like, and the value being provided to the pixel drive circuitry may be termed a "current value" or an "old value" or a "previous value" or the like.

The reader should appreciate that drawings showing methods, and the written descriptions thereof, should also be understood to illustrate machine-accessible media having recorded, encoded, or otherwise embodied therein instructions, functions, routines, control codes, firmware, software, or the like, which, when accessed, read, executed, loaded into, or otherwise utilized by a machine, will cause the machine to perform the illustrated methods. Such media may include, by way of illustration only and not limitation: magnetic, optical, magneto-optical, or other storage mechanisms, fixed or removable discs, drives, tapes, semiconductor memories, organic memories, CD-ROM, CD-R, CD-RW, DVD-ROM, DVD-R, DVD-RW, Zip, floppy, cassette, reel-to-reel, or the like. They may alternatively include down-the-wire, broadcast, or other delivery mechanisms such as Internet, local area network, wide area network, wireless, cellular, cable, laser, satellite, microwave, or other suitable carrier means, over which the instructions etc. may be delivered in the form of packets, serial data, parallel data, or other suitable format. The machine may include, by way of illustration only and not limitation: microprocessor, embedded controller, PLA, PAL, FPGA, ASIC, computer, smart card, networking equipment, or any other machine, apparatus, system, or the like which is adapted to perform functionality defined by such instructions or the like. Such drawings, written descriptions, and corresponding claims may variously be understood as representing the instructions etc. taken alone, the instructions etc. as organized in their particular packet/serial/parallel/etc. form, and/or the instructions etc. together with their storage or carrier media. The reader will further appreciate that such instructions etc. may be recorded or carried in compressed, encrypted, or otherwise encoded format without departing from the scope of this patent, even if the instructions etc. must be decrypted, decompressed, compiled, interpreted, or otherwise manipulated prior to their execution or other utilization by the machine.

Reference in the specification to "an embodiment," "one embodiment," "some embodiments," or "other embodiments" means that a particular feature, structure, or characteristic described in connection with the embodiments is included in at least some embodiments, but not necessarily all embodiments, of the invention. The various appearances "an embodiment," "one embodiment," or "some embodiments" are not necessarily all referring to the same embodiments.

If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

Those skilled in the art having the benefit of this disclosure will appreciate that many other variations from the foregoing description and drawings may be made within the scope of the present invention. Indeed, the invention is not limited to the details described above. Rather, it is the following claims including any amendments thereto that define the scope of the invention.

What is claimed is:

1. An apparatus comprising:

global control logic to provide a write signal to control a display; and a double-buffer circuit including, local control logic to control a portion of the display, coupled to receive the write signal, and to provide a copy signal, a first buffer having a value input to receive a new value from a source and having a control input to receive the write signal, and to store the new value in response to the write signal, and a second buffer having a value input to receive the new value from the first buffer and having a control input to receive the copy signal, and to store the new value in response to the copy signal.

2. The apparatus of claim 1 wherein:

the new value comprises a multi-bit pixel value.

3. The apparatus of claim 1 further comprising:

a plurality of such double-buffer circuits.

4. The apparatus of claim 3 further comprising:

a spatial light modulator having a plurality of pixel display cells each coupled to the second buffer of a respective one of the double-buffer circuits.

5. The apparatus of claim 1 wherein the double-buffer circuit further includes:

another first buffer having a value input to receive another new value from the source and having a control input to receive the write signal, and to store the other new value in response to the write signal, and another second buffer having a value input to receive the other new value from the other first buffer and having a control input to receive the copy signal, and to store the other new value in response to the copy signal.

6. The apparatus of claim 1 wherein:

the first and second buffers to each store a single multi-bit pixel value.

7. The apparatus of claim 1 wherein:

the write signal is implicit.

8. A method comprising:

(A) for each respective new pixel value received from a source, buffering the new pixel value in a first buffer coupled to a corresponding pixel display cell of a spatial light modulator, driving the pixel display cell with a previously received pixel value, and setting a dirty bit to indicate that the pixel display cell has been written to; and (B) at the end of a frame of new pixel values, for each pixel display cell to which a new value was written, committing the buffered new value to an output coupled to drive the pixel display cell, and clearing the dirty bit.

9. The method of claim 8 wherein committing the buffered new value comprises:

copying the new value from a second buffer.

10. The method of claim 8 wherein committing the buffered new value comprises:

toggling a multiplexor coupled to outputs of two buffers, one of which is the first buffer; and toggling operation of local control logic such that upon receipt of a next value written by the source to the same pixel display cell, the other of the two buffers will buffer the next value.

11. A method comprising:

driving respective pixel values of an old frame to corresponding pixel display cells of a display cell array of a spatial light modulator;

receiving a new frame of new pixel values;

for each new pixel value in the new frame, buffering the new pixel value and setting an associated dirty bit while continuing to drive a corresponding pixel value of the old frame to the display cell array; and upon completion of receipt of the new frame, transferring the new pixel values associated with set dirty bits in parallel to corresponding pixel display cells of the display cell array.

12. The method of claim 11 wherein the transferring comprises: latching from a first buffer to a second buffer.

13. The method of claim 11 wherein the transferring comprises:

toggling operation of a multiplexor to pass to its output a value from a first buffer rather than a second buffer.

14. A spatial light modulator comprising:

a display having a plurality of regions, each region including at least one display pixel;

a global controller to provide to each of the regions a respective write signal and a commit signal; and for each of the regions, storage to buffer values including a first buffer and a second buffer, and a local controller coupled to receive the region's write signal and the commit signal, and to provide a control signal to the storage in response to receipt of the commit signal if the write signal was received subsequent to a prior receipt of the commit signal, wherein the control signal to cause one of the first and second buffers to present its buffered value to the display.

15. The spatial light modulator of claim 14 wherein:

the first and second buffers are configured as a back-front buffer and the control signal comprises a copy signal.

16. The spatial light modulator of claim 14 wherein:

the first and second buffers are configured as a ping-pong buffer with a multiplexor and the control signal comprises, a multiplexor control signal coupled to the multiplexor, a first read enable signal coupled to the first buffer, and a second read enable signal coupled to the second buffer.

17. The spatial light modulator of claim 16 wherein:

the local controller is coupled to issue one of the first and second read enable signals, and the other of the first and second read enable signals to be generated by an inverted input at one of the first and second buffers.

18. The spatial light modulator of claim 14 wherein:

each region contains exactly one display pixel, and each display pixel has its own dedicated local controller.

19. A method comprising:

driving at least one display pixel of each region of a display according to a present value stored in a first buffer of a double-buffering mechanism uniquely associated with that region;

updating a second buffer of the double-buffering mechanism of less than all of the regions; and driving the at least one display pixel of each region according to the present value if the region was not updated, and according to the updated second buffer if the region was updated.

20. The method of claim 19 wherein updating comprises:

writing a new value to the second buffer; and copying the new value from the second buffer to the first buffer.

21. The method of claim 19 wherein updating comprises:

writing a new value to the second buffer;

making the second buffer be driving; and making the first buffer be non-driving.

22. The method of claim 21 wherein the makings are accomplished by:

toggling operation of a multiplexor coupled to outputs of the buffers.

23. The method of claim 19 wherein:

at least one of the regions includes a plurality of pixels.

24. The method of claim 19 wherein the display comprises a spatial light modulator.

25. An apparatus comprising:

a global controller to generate a first signal and a second signal to control a display array; and a plurality of local circuits each coupled to receive the first signal and the second signal, each of the plurality of local circuits to control a corresponding portion of the display array, comprising:

a first storage element to store data to drive the corresponding portion of the display array, a second storage element to store data to drive the corresponding portion of the display array, a local controller to enable one of the first storage element and the second storage element to latch new data, and a multiplexer to receive an output of the first storage element and the second storage element, the multiplexer controlled by the local controller.

26. The apparatus of claim 25, wherein the local controller to cause the multiplexer to select data from the first storage element or the second storage element in response to the second signal.

27. The apparatus of claim 25, wherein the local controller in response to the first signal to toggle the multiplexer if the second signal was received subsequent to a prior receipt of the first signal.

28. The apparatus of claim 25, further comprising a spatial light modulator having a plurality of pixel display cells each coupled to receive the data passed by the multiplexer of a respective local circuit.

29. The apparatus of claim 25, wherein the first and second storage elements each to store a single multi-bit pixel.

* * * * *